US005913090A

United States Patent [19]

Sawada et al.

[11] Patent Number: 5,913,090

[45] Date of Patent: Jun. 15, 1999

[54] IMAGE FORMING APPARATUS SERVICE SYSTEM

[75] Inventors: Masaithi Sawada, Tokyo; Ryoichi Ishikawa, Gotenba, both of Japan

[73] Assignee: Ricoh Company, Ltd., Tokyo, Japan

[21] Appl. No.: 08/866,390

[22] Filed: May 30, 1997

[30] Foreign Application Priority Data

May 31, 1996 [JP] Japan ..... 8-138181

[51] Int. Cl.[6] ..... G03G 15/00

[52] U.S. Cl. ..... 399/8; 399/21

[58] Field of Search ..... 399/8–11, 21; 379/100.05

[56] References Cited

U.S. PATENT DOCUMENTS

| | | | |
|---|---|---|---|
| 4,583,834 | 4/1986 | Seko et al. | 399/8 |
| 5,369,471 | 11/1994 | Yamada | 399/8 |
| 5,424,808 | 6/1995 | Maekawa et al. | 399/18 |
| 5,434,650 | 7/1995 | Nakahara et al. | 399/8 |
| 5,596,390 | 1/1997 | Sawada | 399/8 |
| 5,715,496 | 2/1998 | Sawada et al. | 399/8 |
| 5,790,916 | 8/1998 | Sawada | 399/21 |

FOREIGN PATENT DOCUMENTS

| | | |
|---|---|---|
| 0 259 144 | 3/1988 | European Pat. Off. . |
| 0 509 528 | 10/1992 | European Pat. Off. . |
| 0 599 606 | 6/1994 | European Pat. Off. . |

*Primary Examiner*—William Royer
*Attorney, Agent, or Firm*—Oblon, Spivak, McClelland, Maier & Neustadt, P.C.

[57] ABSTRACT

An image forming apparatus service system of the present invention includes a shared managing unit capable of predicting whether or not a serviceman's visit is necessary on the basis of data received from each of a plurality of image forming apparatuses, including low CV layer apparatuses, operated in a broad area including a number of service stations. The service system therefore allows a serviceman to take an adequate measure rapidly and efficiently before a critical trouble occurs in any one of the apparatuses.

17 Claims, 11 Drawing Sheets

COPIER
COPIER
COPIER
COPIER
COPIER
1
1
1
1
1
DATA COMMUNICATION UNIT
2
COMMUNICATION NETWORK
3
MANAGING UNIT (HOST COMPUTER)
4
COMMUNICATION NETWORK
5
TERMINAL UNIT
TERMINAL UNIT
TERMINAL UNIT
TERMINAL UNIT
6
6
6
6
SERVICE STATIONS

| Fig. 5A |
| --- |
| Fig. 5B |

IMAGE FORMING APPARATUS SERVICE SYSTEM

BACKGROUND OF THE INVENTION

FIELD OF THE INVENTION

The present invention relates to a service system for allowing copiers, facsimile apparatuses, printers or similar image forming apparatuses located at users' stations to be maintained, repaired or otherwise serviced rapidly and adequately.

DISCUSSION OF THE BACKGROUND

Image forming apparatuses using papers are extensively used today. With these kinds of apparatuses, it is difficult to fully obviate jams and other errors. Therefore, such an apparatus is so devised as to allow the user to, e.g., remove a jamming paper without resorting to a serviceman as far as possible. However, because jams and other errors which cannot be dealt with by the user sometimes occur, it is a common practice for the user to make a maintenance contract with a manufacturer or a distributor. The maintenance contract insures periodic inspection and maintenance by a serviceman as well as rapid repair at the time of the occurrence of a trouble.

Japanese Patent Laid-Open Publication Nos 3-293369 and 5-80609, for example, each teaches a system in which many copiers operated at different locations are connected to a managing unit or host computer situated at a control center by a telephone network or similar communication network. In this system, data representative of a jam or similar error is automatically sent from the individual copier to the control center. The managing unit therefore can control a number of copiers at the same time at a remote station.

Specifically, in the system disclosed in the above Publication No. 3-293369, jams occurring in an individual copier are detected and counted location by location within the copier. The frequency (maximum value, minimum value, mean value, mean value of differences, etc.) of jams occurring during a preselected number of times, e.g., 1,000 times of copy processing is computed every time a jam occurs or every time a paper is driven out of the copier. When the frequency exceeds an allowable value particular to the location in the copier, alarm data or similar control data showing that the frequency of jam is abnormal from the copier is sent to a central control unit situated at the control center via a public telephone network. This allows the control center to see the abnormal jam frequency immediately and take an adequate measure, e.g., sending a serviceman.

In the above Publication No. 5-80609, the individual copier also detects and stores a jam or similar defective paper transport during image forming sequence location by location within the copier. When, for example, a defective transport occurs before a preselected number of copies are produced or before a preselected period of time expires, or when defective transport of the same kind occurs continuously, defective transport data stored in the copier is sent to a host computer situated at a service center via a communication network. In response, the host computer allows the operator at the service center to see the defective transport data on, e.g., a display.

However, the conventional copier and managing unit described above have some problems left unsolved, as follows. The copier determines the timing for storing jams and other error data and the timing for sending the data to the managing unit. The managing unit simply transfers the received data to the operator via, e.g., a display. The operator therefore must decide or predict the occurrence of an error based on the received data, and then determine whether or not a serviceman's visit is necessary. If a serviceman's visit is necessary, the operator must request a serviceman at a service station to visit the user's station on the phone or by facsimile, and selectively transfer data relating to, e.g., the copier to be dealt with and its conditions to the serviceman.

Moreover, if all the data received from the individual copier are transferred to the service station, the operator at the service station must determine whether they are representative of an error which would result in a critical trouble or whether they are simply representative of the conditions. This not only wastes time and labor, but also increases the communication cost. To solve this problem the copier may limit the data to be sent and the timing for transmitting them, as stated earlier. However, should the data and timing be extremely limited, it would be impossible for the operator at the control center to predict a trouble and whether or not a serviceman's visit is necessary (remote diagnosis).

In light of the above, Japanese Patent Application No. 7-6612, for example, teaches an image forming apparatus service system including a managing unit shared by many image forming apparatuses. In this service system, the individual image forming apparatus executes processing including the counting of jams. When the probability of frequent jam is high, the apparatus sends jam alarm data indicative of such a probability to a managing unit. The managing unit sequentially stores the jam alarm data received from the individual image forming apparatus, and determines the tendency of the data. When the determined tendency matches a preselected tendency pattern, the managing unit predicts that a serviceman's visit is necessary, i.e., that a trouble has occurred. Then, the managing unit reports this prediction to a terminal unit located at a service station covering the apparatus to be dealt with.

The above trouble prediction scheme using the tendency pattern is extremely advantageous when the image forming apparatus is of the kind using a relatively great number of papers, i.e., belonging to a high CV layer. However, such a scheme is not always effective when the apparatus is of the type using a relatively small number of papers, i.e., belonging to a low CV layer. Specifically, the managing unit cannot determine the tendency unless it stores a certain amount of jam alarm data received from the individual apparatus. Therefore, the number of times of transmission of the jam alarm data to the managing unit is far smaller when use is made of a low CV layer apparatus than when use is made of a high CV layer apparatus. It is therefore likely that a critical trouble occurs in the apparatus to be dealt with before the managing unit fully determines the tendency of the jam alarm data.

SUMMARY OF THE INVENTION

It is therefore an object of the present invention to provide an image forming apparatus service system capable of automating a serviceman request based on data received from the individual image forming apparatus, whether it be the high CV layer type or the low CV layer type, lying in a broad area including a number of service stations, and thereby allowing an adequate measure to be taken rapidly and efficiently before a critical trouble occurs in the apparatus.

An image forming apparatus service system of the present invention has a plurality of image forming apparatuses, a managing unit connected to the image forming apparatuses by a communication network for remote-managing the apparatuses, and a plurality of terminal units connected to the managing unit by a communication network, and each being located at a particular service station. The image forming apparatuses each sends, when an abnormal phenomenon or pre-phenomenon occurs during operation, alarm data indicative of the phenomenon or pre-phenomenon to the managing unit. The managing unit analyzes the alarm data received to thereby selectively send data relating to maintenance or repair to the terminal units. The managing unit has a received data storage for storing data received from any one of the image forming apparatuses, an analyzer for analyzing the data stored in the received data storage, a predictor for predicting, based on the result of analysis output from the analyzer, whether or not a serviceman's visit is necessary, and a transmitting section for transmitting the result of prediction output from the predictor to one of the terminal units located at the service station covering the apparatus needing a serviceman's visit.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
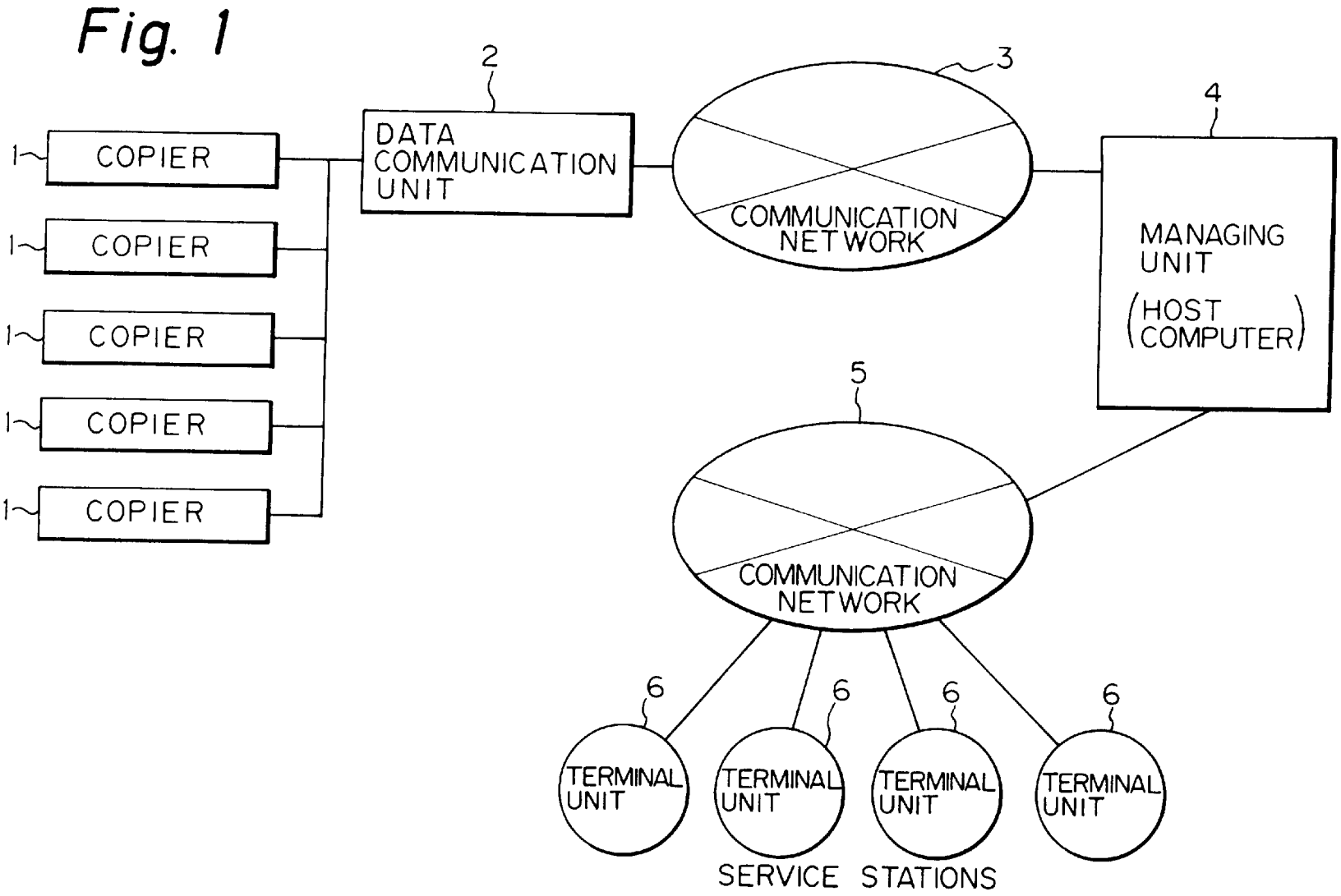
FIG. 1 is a block diagram schematically showing an image forming apparatus service system embodying the present invention.

Referring to FIG. 1 of the drawings, an image forming apparatus service system embodying the present invention is shown. As shown, the system includes a number of copiers 1 located at offices or similar users' stations. Of course, the copiers 1 may be implemented as any other image forming apparatuses, e.g., copiers or facsimile apparatuses. All the copiers 1 are connected to a shared managing unit (host computer) 4 via a data communication unit 2 and a communication network 3. Terminal units 6 are each located at a particular service station and connected to the managing unit 4 via a communication network 5. The networks 3 and 5 may each be implemented by a telephone network or similar public network.

Each copier 1 detects jams occurred on a paper transport path location by location, and counts or resets the resulting jam occurrence data location by location. When the count of the data coincides with a preselected reference value, jam alarm data showing that a jam is apt to occur often in the copier 1 is generated as alarm data reporting an abnormal phenomenon or pre-phenomenon. The jam alarm data is sent to the managing unit 4 together with condition data including the integrated numbers of copies (images formed) occurred when a preselected number of latest jam alarm data were generated, as will be described specifically later. The managing unit, or manager as referred to hereinafter, 4 stores the data received from the individual copier 1, and analyzes the data in order to predict a trouble and whether or not a serviceman's visit is necessary. If a serviceman's visit is necessary, the manager 4 automatically sends necessary data to one of the terminal units 6 situated at the service station covering the copier 1 to be dealt with. The terminal units 6, implemented as personal computers, each stores the data received from the manager 4 and informs a serviceman with the location of the copier 1 needing a service, while displaying, e.g., the conditions of the copier 1.

Figure 2:
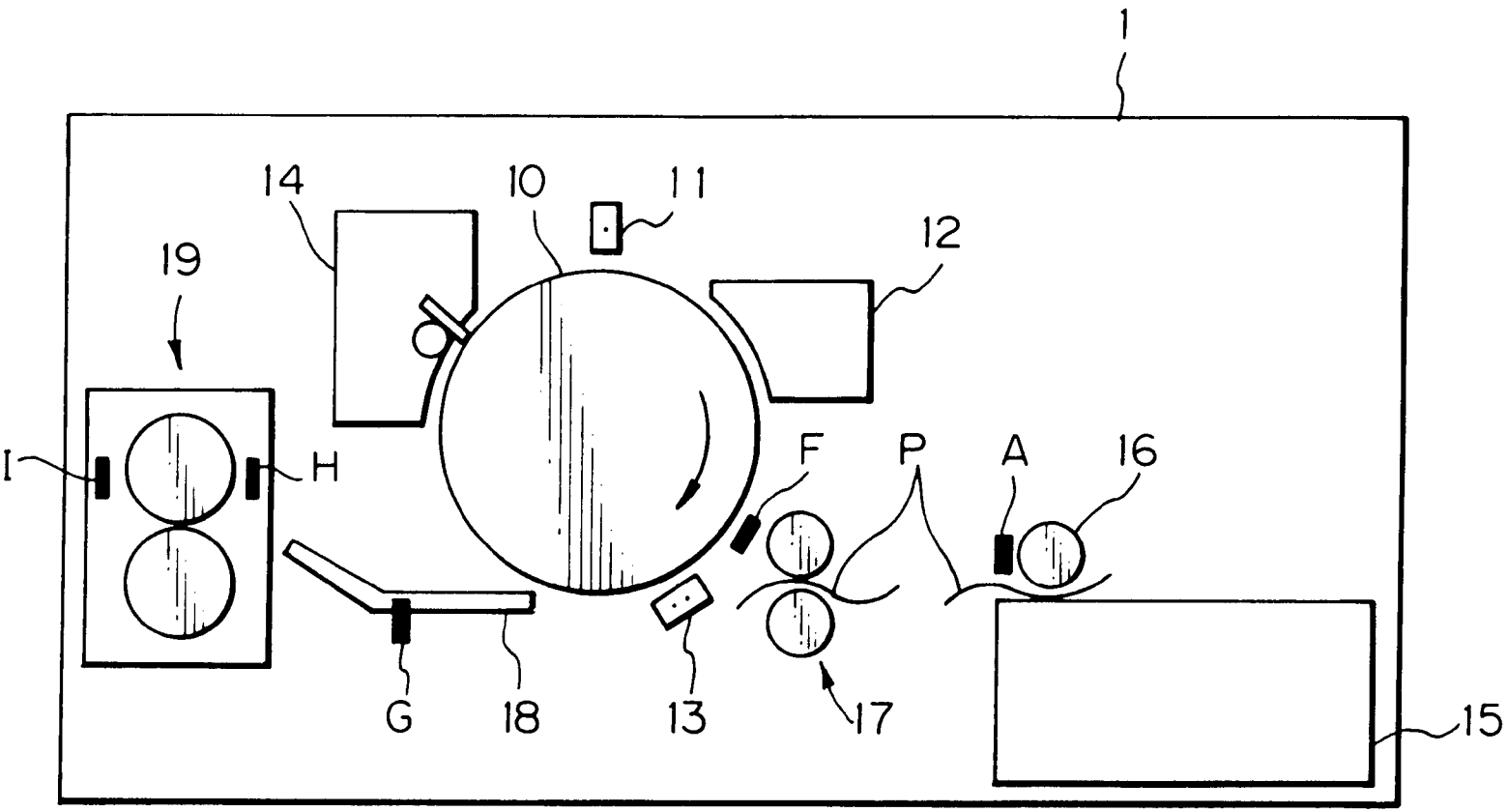
FIG. 2 shows various sections of the individual copier of FIG. 1 joining in image formation, and various sensors responsive to a paper being conveyed along a paper transport path.

The construction of each copier 1 will be described more specifically with reference to FIG. 2. FIG. 2 shows various sections of the copier 1 joining in image formation and a number of sensors arranged on a paper transport path. As shown, the copier 1 includes a photoconductive element in the form of a drum 10. Arranged around the drum 10 are a main charger 11, a developing unit 12, a transfer charger 13, and a cleaning unit 14.

In operation, while the drum 10 is rotated in the direction indicated by an arrow in FIG. 2, the main charger 11 charges the surface of the drum 10 uniformly. A scanner and an exposing device, not shown, cooperate to expose the charged surface of the drum 10 imagewise. As a result, a latent image representative of a document image is electrostatically formed on the drum 10. The developing unit 12 develops the latent image by depositing toner thereon. A pick-up roller 16 feeds a sheet of paper P from a stack of papers from a paper tray 15 one by one. A registration roller pair 17 drives the paper P toward an image transfer position adjoining the drum 10 at a preselected timing. The transfer charger 13 transfers the toner image from the drum 10 to the paper P at the image transfer position. A paper conveying section 18, implemented by a belt by way of example, conveys the paper P carrying the toner image thereon to a fixing unit 19. After the toner image has been fixed on the paper P by the fixing unit 19, the paper or copy is driven out of the copier 1. After the image transfer, the surface of the drum 10 is cleaned by the cleaning unit 14 in order to prepare for the next charging step.

The sensors arranged along the above paper transport path for sensing the paper P are as follows. A paper feed sensor A is located at the paper outlet side of the pick-up roller 16. A registration sensor F is positioned at the paper outlet side of the registration roller pair 17. A conveyance sensor G is included in the conveying section 18. A fixation inlet sensor H and a fixation outlet sensor I are respectively positioned at the inlet side and outlet side of the fixing unit 19. Defective paper transport, i.e., jam and the location where it occurred can be detected by monitoring the outputs of the above sensors and the durations of paper transport. In the event of a jam, the copier 1, like a conventional copier, displays it on its operation and display panel and stops operating.

Figure 3A:
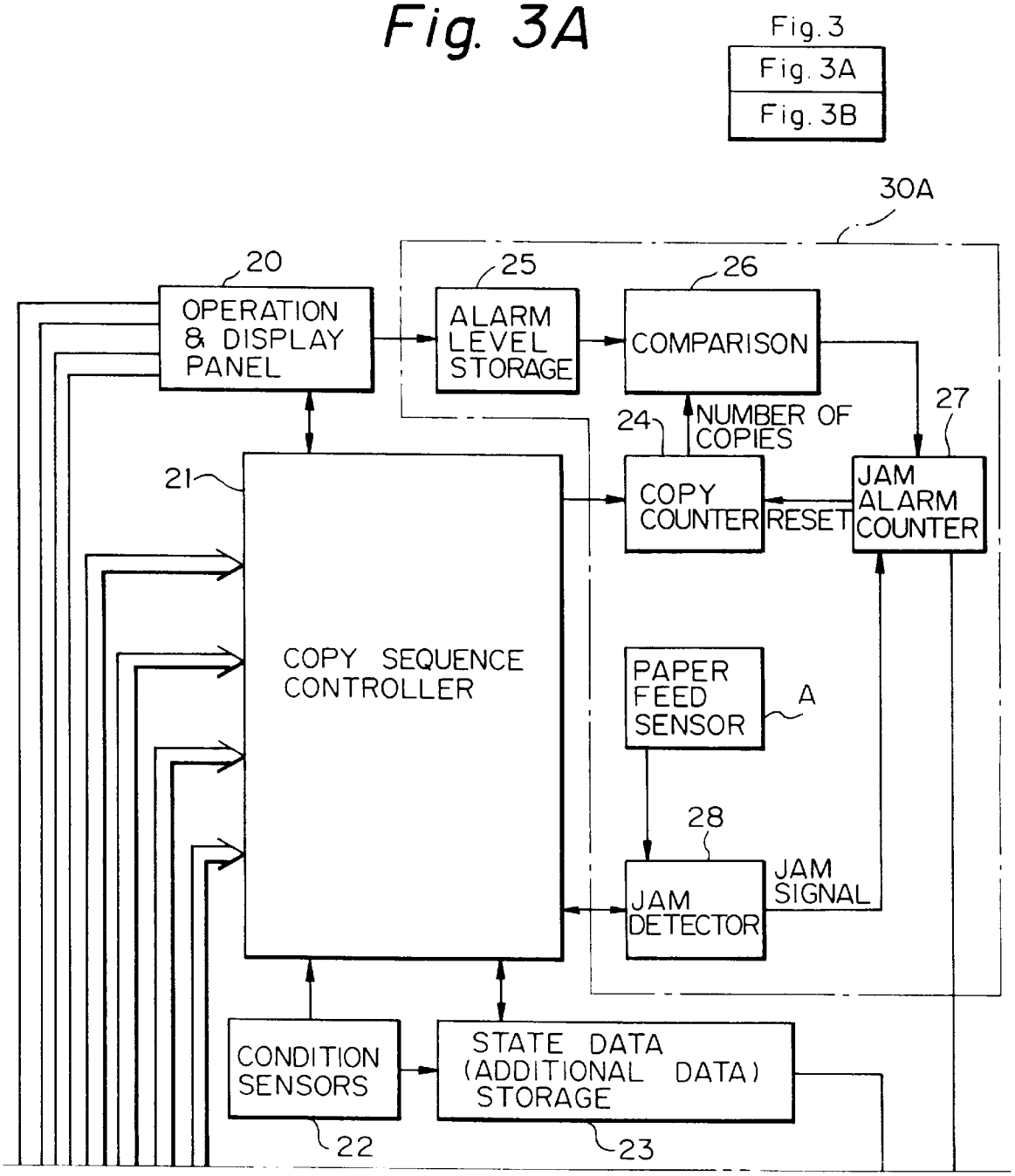
FIG. 3 is a block diagram schematically showing the configuration of the individual copier included in the embodiment.
Figure 3B:
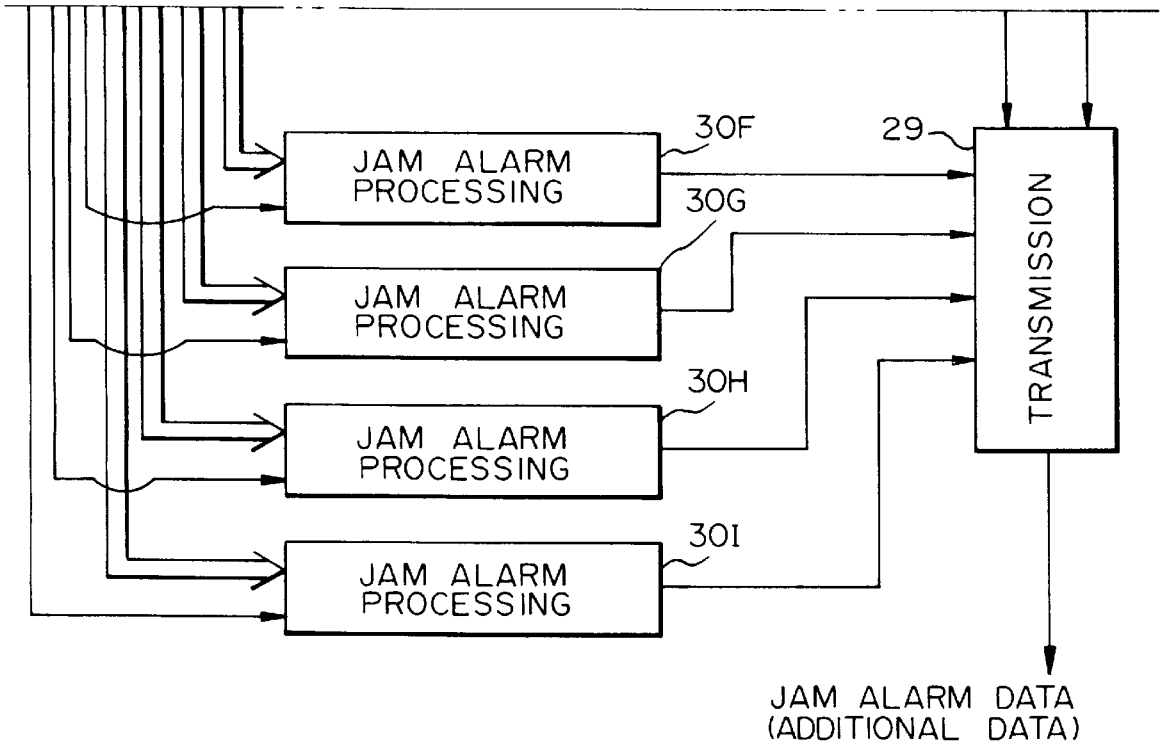

FIG. 3 shows various functions included in the copier 1. As shown, an operation and display panel 20 includes a start key, numeral keys and other various keys (switches), and a display for displaying various kinds of data. A particular standard jam value (corresponding to the number of copies) can be set on the panel 20 for each of the locations where a paper jam occurs. The standard jam value is used to determine whether or not a jam occurred is critical. Also, a particular standard jam value can be set on the panel 20 for each of jam alarm counters 27, which will be described, taking account of the user characteristic (emotional factor, environmental factor, etc.); alternatively, default values particular to the copier 1 and stored beforehand can be corrected and set. Further, a desired reference value for each jam alarm counter 27 to determine whether or not to output jam alarm data can be set on the panel 20.

A copy sequence controller 21 is implemented as a microcomputer and controls the copy sequence of the copier 1. When the start key of the panel 20 is pressed, the copy sequence controller 21 sequentially controls the various sections shown in FIG. 2 as well as the scanner, exposing device, motors, clutches and high-tension power sources, thereby controlling the procedure for reproducing a document image on the paper P. At the same time, the controller 21 controls the entire operation of the copier 1. Condition sensors 22 are responsive to temperature (and humidity) inside the copier 1, fixing temperature, surface potential of the drum 10, presence/absence of various supplies, etc. A state data storage or memory 23 stores state data output from the controller 21 and sensors 22. The state data are additional data to be sent together with jam alarm data.

Table 1 shown below lists specific state data representative of the history of the latest ten times of jam (copier state data at the time when the latest ten jam alarm data were generated). Each state data consists of the cause (or location) of a jam, a paper size, and a count of a total counter (TC) included in the copy sequence controller 21 for determining the integrated number of copies produced. In addition, the state data include the conveying time of the pick-up roller 16, FIG. 2, fixing temperature, and image density.

TABLE 1

| LATEST 10 JAMS HISTORY DATA | CAUSE | PAPER SIZE | TC VALUE |
|---|---|---|---|
| JAM HISTORY DATA: 1 | paper tray | A3 | 50 |
| JAM HISTORY DATA: 2 | paper tray | A4 | 90 |
| JAM HISTORY DATA: 3 | paper tray | A4 | 120 |
| JAM HISTORY DATA: 4 | fixing unit | A3 | 140 |
| JAM HISTORY DATA: 5 | paper tray | A4 | 150 |
| JAM HISTORY DATA: 6 | paper tray | A4 | 180 |
| JAM HISTORY DATA: 7 | paper tray | A4 | 225 |
| JAM HISTORY DATA: 8 | conveying section | B5 | 355 |
| JAM HISTORY DATA: 9 | conveying section | A4 | 495 |
| JAM HISTORY DATA: 10 | fixing unit | A3 | 655 |

The copy sequence controller 21 feeds a count signal to a copy counter 24 every time a single copying operation (discharge of a copy) ends. The copy counter 24 therefore counts copies continuously produced without any jam. An alarm level storage 25 stores an alarm level beforehand or when it is input on the operation panel 20. The alarm level, or standard jam value, is assigned to a first location (to which the sensor A is responsive) and representative of the number of copies produced without any jam and necessary for determining whether or not the jam occurrence data is valid and for resetting the jam alarm count. The alarm level storage 25 is implemented by a nonvolatile memory in order to hold the data even when a power switch, not shown, is turned off. A comparison 26 compares the count output from the copy counter 24 and the alarm level output from the alarm level storage 25. When the count reaches the alarm level, the comparison 26 delivers a coincidence signal to a jam alarm counter 27.

When the jam alarm counter 27 receives a jam signal from a jam detector 28, the counter 27 increments a jam alarm count, i.e., counts the jam occurrence data while sending a reset signal to the copy counter 24. As a result, the copy counter 24 is reset. On receiving the coincidence signal from the comparison 26, and if the jam alarm count is not zero, the counter 27 resets the jam alarm count to zero. When the jam alarm count reaches a preselected reference value, e.g., "10", the counter 27 sends to a transmission 29 jam alarm data showing that the probability of frequent jam is high. At the same time, the counter 27 sends a reset signal to the copy counter 24.

While the copy sequence controller 21 executes the copying operation, the jam detector 28 monitors the output of the paper feed sensor A in relation to a period of time of paper conveyance so as to determine whether or not a jam has occurred. Specifically, if the sensor A does not sense a paper within a preselected period of time since the start of paper feed, or when the sensor A continuously senses a paper for more than a preselected period of time, the jam detector 28 determines that a jam has occurred and delivers a jam signal relating to the first location to the jam alarm counter 27. Also, the jam signal causes the copy sequence controller 21 to interrupt the copying operation and to display the jam and its location on the panel 20. Usually, the operator, watching the panel 20, removes the jamming paper and then effects recovery.

The paper feed sensor A, jam detector 28, copy counter 24, alarm level storage 25, comparison 26 and jam alarm counter 27 stated above constitute a jam alarm processing 30A assigned to the first location. Jam alarm processings 30F, 30G, 30H and 30I are respectively assigned to a second, a third, a fourth and a fifth location. The processings 30F–30I are identical in configuration with the processing 30A except that they respectively include the registration sensor F, conveyance sensor G, fixation inlet sensor H and fixation outlet sensor I in place of the paper feed sensor A. The processings 30F–30I are connected between the operation and display panel 20 and sequence controller 21 and the transmission 29.

As for the jam alarm processing 30F, the jam detector 28 monitors the output of the registration sensor F in relation to a period of time of paper conveyance in order to determine whether or not a jam has occurred. Specifically, if the sensor F does not sense a paper within a preselected period of time after the paper feed sensor A has sensed it, or if the sensor F continuously senses a paper for more than a preselected period of time, the processing 30F determines that a jam has occurred and delivers a jam signal relating to the second location to the jam alarm counter 27 included in the processing 30F. As for the other functions, the processing is identical with the processing 30A.

Likewise, the jam detectors 28 included in the other jam alarm processings 30G–30I respectively monitor the outputs of the conveyance sensor G, fixation inlet sensor H and fixation outlet sensor I in relation to periods of time of conveyance. If any one of the sensors G–I does not sense a paper within a preselected period of time after the sensor located upstream of that sensor has sensed it, or if the above sensor continuously senses a paper for more than a predetermined period of time, the processing associated with the above sensor determines that a jam has occurred and delivers a jam signal to the alarm counter included in the processing. As for the other functions, the processings 30G–30I are identical with the processing 30A.

The jam signals output from the processings 30G–30I also cause the copy sequence controller 21 to interrupt the copying operation and to display the jams and their locations on the panel 20. Usually, the operator, watching the panel 20, removes the jamming papers and effects recovery. If desired, the outputs of the sensors A, F, G, H and I may be directly input to the copy sequence controller 21, in which case common jam detecting means will be built in the controller 21 in order to detect jams location by location.

On receiving the jam alarm data from the jam alarm counter 27 of any one of the jam alarm processings 30A, 30F, 30G, 30H and 30I, the transmission 29 sends the data to the manager 4, FIG. 1, via the data communication unit 2 and network 3 together with the state data (additional data including the cause of the jam and the TC value) and ID identifying the copier 1. Further, when any other abnormal phenomenon, e.g., serviceman call or sensor error occurs, the transmission 29 can send alarm data indicative of such a phenomenon to the manager 4.

Figure 4:
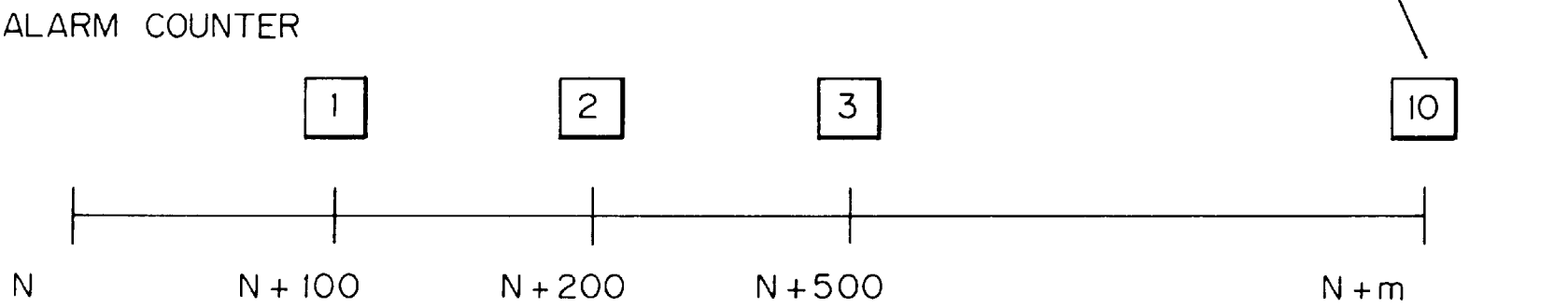
FIG. 4 demonstrates a specific operation of a jam alarm counter included in the embodiment.

Validity of the jam alarm data output from the jam alarm processings 30A and 30F–30I will be described hereinafter. The processing 30A and 30F–30I respectively assigned to the first to fifth locations each includes the jam alarm counter 27. When the number of jam signals output from the jam detector 28 associated with the jam alarm counter 27 reaches the reference value, the counter 27 outputs the jam alarm data. However, when the count of the copy counter 24, i.e., the number of copies produced without any jam reaches, before the number of jam signals reaches the reference value, the alarm level or standard jam value stored in the associated alarm level storage 25, the counter 27 resets its count and does not output any jam alarm data. This will be described specifically with reference to FIG. 4.

The condition for the jam signal to increment (+1) the count of the jam alarm counter 27 (alarm counter hereinafter) is that the alarm counter be smaller than the standard jam value or alarm level. Assume that the standard jam value is 1,000 (copies) by way of example. Then, in FIG. 4, the alarm counter is incremented when a jam occurs before the number of copies increases from N to N+1,000. The alarm counter will be again incremented if a jam occurs before 1,000 more copies are produced. In the specific case shown in FIG. 4, a jam occurs at the "N+100" copy, "N+200" copy, and "N+500" copy, sequentially incrementing the alarm counter to "1", "2" and "3". This kind of jam data incrementing the alarm counter are valid data. That is, when values containing the cause of some error and input to the jam alarm counter 27 reach the reference value ("10" in the embodiment) assigned to the same location (same cause), it is determined that the probability of frequent jam is extremely high at the above location due to some cause. As a result, the jam alarm data is sent from the copier 1 to the manager 4, FIG. 1, as stated earlier. In the specific case in FIG. 4, the jam alarm data is sent when the alarm counter reaches "10" at the "N+m" copy.

On the other hand, assume that the jam occurred three times until the "N+500" copy and incremented the alarm counter to "3", but the cause of the error was naturally removed later for some reason (e.g. removal of dust from a paper feed clutch). Then, the number of copies produced exceeds the standard jam value. In this case, it is determined that the future probability of frequent jam is low. Therefore, the data of the alarm counter is determined to be different from and to have no influence on the cause of future jams. Such data is invalid data. The alarm counter is reset or cleared to zero in order to enhance the accuracy of jam alarm data.

To summarize the above construction, a particular jam alarm processing section including the respective jam alarm counter 27 is assigned to each preselected location where a jam occurs. When a jam occurs at any one of the preselected locations, the jam alarm counter 27 assigned to that location is incremented if the number of copies counted since the last counting (or resetting) is smaller than the standard jam value, meaning that the jam alarm data is valid. If the number of copies counted since the last counting (or resetting) is greater than the standard jam value, it is determined that a jam has occurred, but the jam alarm data is invalid; the jam alarm counter 27 is reset. In this manner, only the latest valid jams are counted location by location. When any one of the jam alarm counters 27 reaches the standard jam value (e.g. N =10), the counter 27 outputs the jam alarm data showing that the jam is apt to occur frequently in the near future.

The reference values for outputting the jam alarm data may be implemented as location-by-location default values particular to the copier 1, or as desired values input on the panel 20. The reference values, like the standard jam values (alarm levels), can be varied, as desired, in accordance with the previously mentioned user characteristic, the recent operation conditions, etc.

The location-by-location standard jam values may each be implemented as a value for the jam alarm counter 27 to determine whether or not to count the jam occurrence data, and a value for the counter 27 to determine whether or not to reset its count.

Figures 5, 5A:
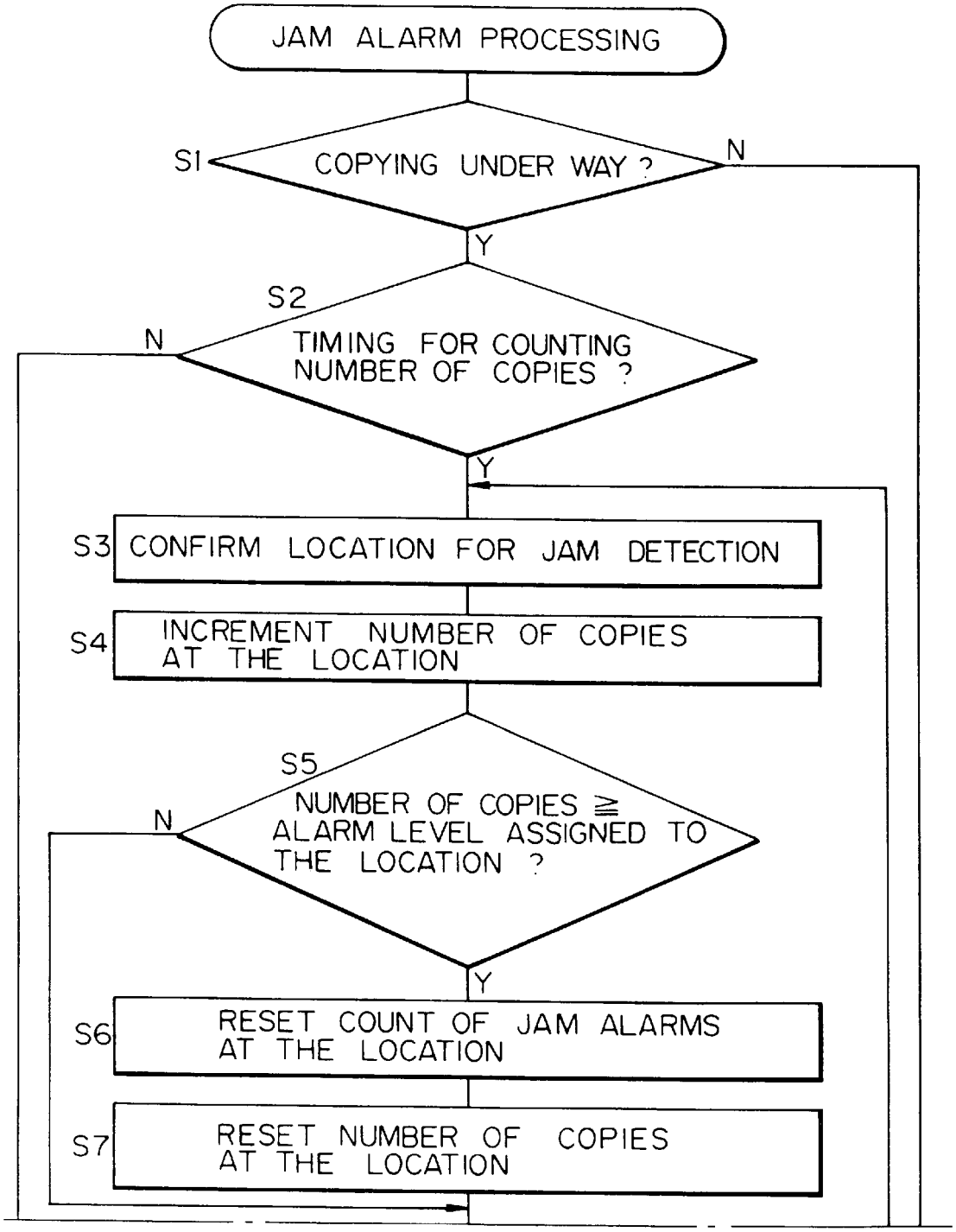
FIG. 5 is a flowchart showing a routine to be executed by the copier of the embodiment and relating to jam alarm processing.
Figure 5B:
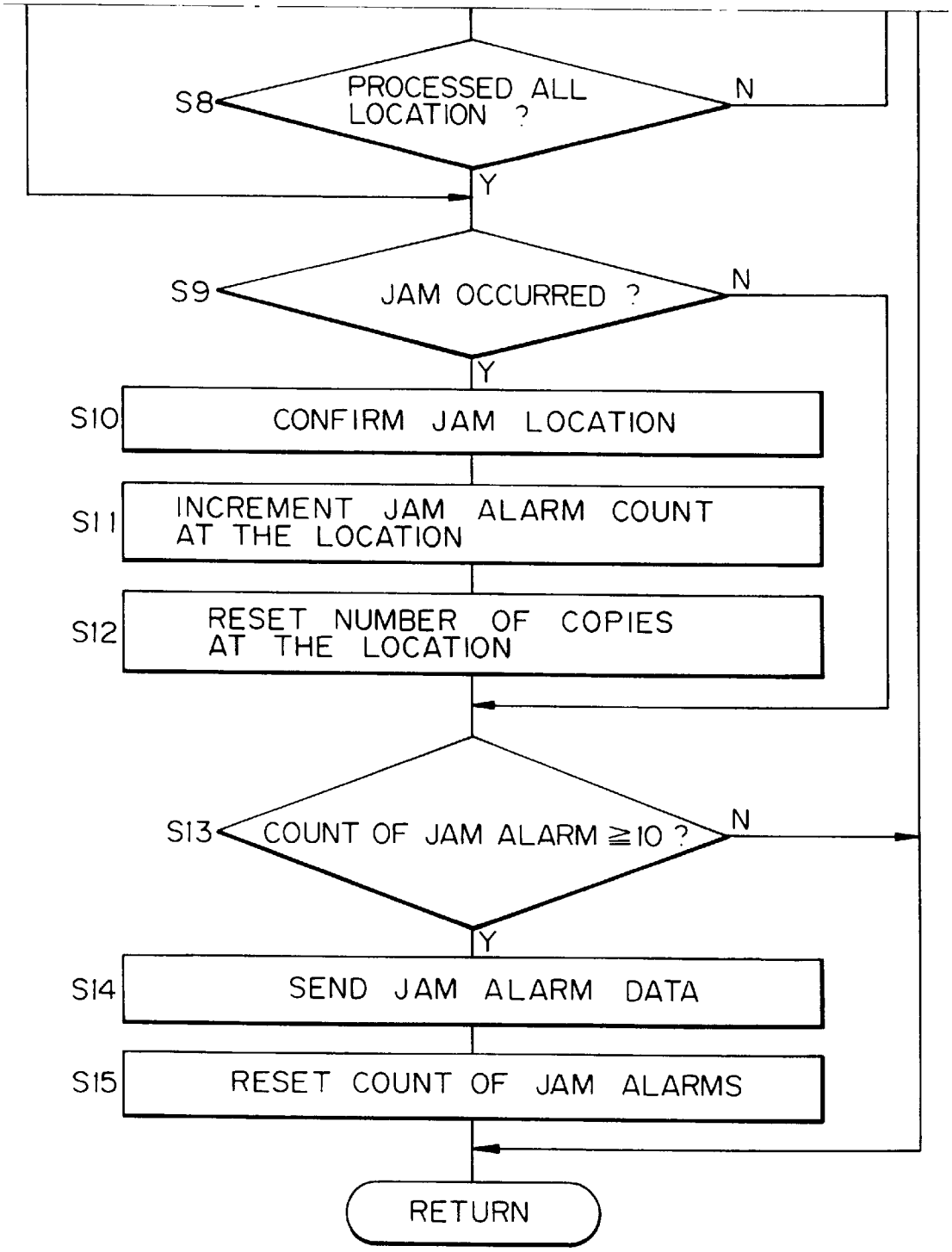

Reference will be made to FIG. 5 for describing the above jam alarm processing of the copier 1 more specifically. As shown, whether or not a copying operation is under way is determined (step S1). Only if the answer of step S1 is positive (Y), is the routine shown in FIG. 5 validated. If the answer of step S1 is negative (N), the program simply returns to a main routine, not shown. When the answer of step S1 is Y, whether or not a timing for counting a copy is reached is determined (step S2). If the answer of step S2 is Y, a location for detecting a jam is confirmed (step S3). Then, a copy reached the above location is counted (+1) (step S4). If the answer of step S2 is N, the procedure is transferred to step S9. In step S5 following step S4, the actual number of copies and the alarm level assigned to the above location are compared to see if the number of copies is greater than or equal to the alarm level or not (e.g. 1,000 copies). If the answer of step S5 is Y, the jam alarm count of the location is reset (step S6), and then the count of copies at the same location is reset (step S7).

If the answer of step S5 is N, whether or not steps S3–S7 have been completed for all the preselected locations where the sensors A and F–I are located (step S8) is determined. If the answer of step S8 is N, the program returns to step S3 in order to repeat the same procedure for the next location. If the answer of step S8 is Y, step S9 is executed.

In step S9, whether or not a jam has occurred is determined. If the answer of the step S9 is Y, the location of the jam is determined (step S10). Then, the count of the jam alarm counter assigned to the above location is incremented (+1) (step S11). Subsequently, the number of copies relating to the same location is reset (step S12), and the program advances to step S13. If the answer of step S9 is Y, step S13 is executed, skipping step S12. In step S13, whether or not the count of the jam alarm counter has reached the preset reference value ("10" in the embodiment) is determined. If the answer of step S13 is Y, jam alarm transmission is effected (transmission of the jam alarm data and additional data together with the copier ID) (step S14). Subsequently, the jam alarm counter is reset (step S15). If the answer of step S13 is N, the program escapes from this routine.

It is therefore possible to detect, only when the probability of frequent jam in the near future is high at any one of the preselected locations, the probability accurately and send jam alarm data to the manager 4 with a relatively simple configuration, without resorting to a mass memory, and at low cost. Because no wasteful data are sent to the manager 4, the communication cost is reduced while the prediction of a trouble (whether or not a serviceman's visit is necessary) at the manager 4 is facilitated.

Figure 6:
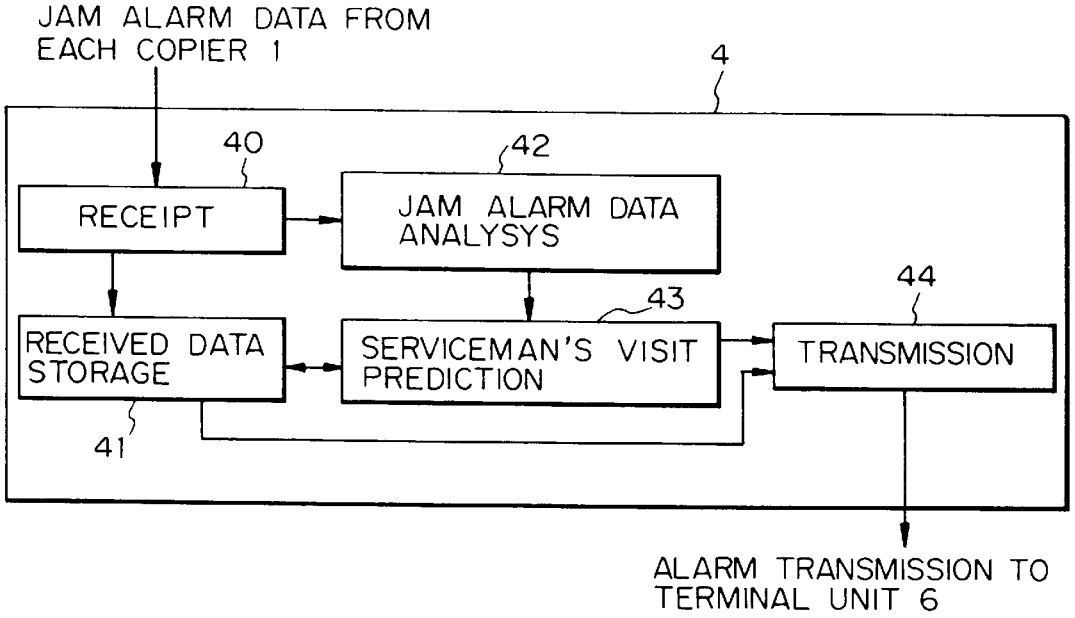
FIGS. 6 and 7 are schematic block diagrams respectively showing the construction of a managing unit and that of a terminal unit included in the embodiment.

FIG. 6 shows the construction of the manager or host computer 4 shown in FIG. 1. As shown, the manager 4 has a receipt 40, a received data storage 41, a jam alarm data analysis 42, a serviceman's visit prediction 43, and a transmission 44. The receipt 40 receives the jam alarm data (indicative of the location or locations where the jam occurs frequency) and additional data (including the jam history data of Table 1 and serviceman call, sensor error and other abnormal phenomena or pre-phenomena) from the individual copier 1. The received data storage 41 sequentially stores the received data by copier based on the copier IDs.

Every time the receipt 40 receives the jam alarm data from any one of the copiers 1, the analysis 42 analyzes the data as well as the state data of the copier 1 stored in the storage 41. The analysis 42 performs error prediction or similar remote diagnosis on the basis of the result of analysis. In this case, the analysis 42 may immediately determine that the jam is apt to occur frequently in the near future at the location indicated by the data. Also, the analysis 42 determines, on receiving serviceman call data, sensor error data or similar abnormality data, that an error has occurred. Further, when the receipt 40 additionally receives the total number of copies, the analysis 42 may store, e.g., the history of the difference between the received total number and the last total number, and use it for error diagnosis or for decision on the time for maintenance.

The serviceman's visit prediction 43 determines, based on the result of prediction or diagnosis output from the analysis 42, whether or not a serviceman's visit is necessary. If a serviceman's visit is necessary, the prediction 43 delivers serviceman's visit request data and, among the data stored in the storage 41, the data necessary for a service to the transmission 44. The transmission 44 sends such data to one of the terminal units 6 located at the service station covering the copier 1 needing a service.

Figure 7:
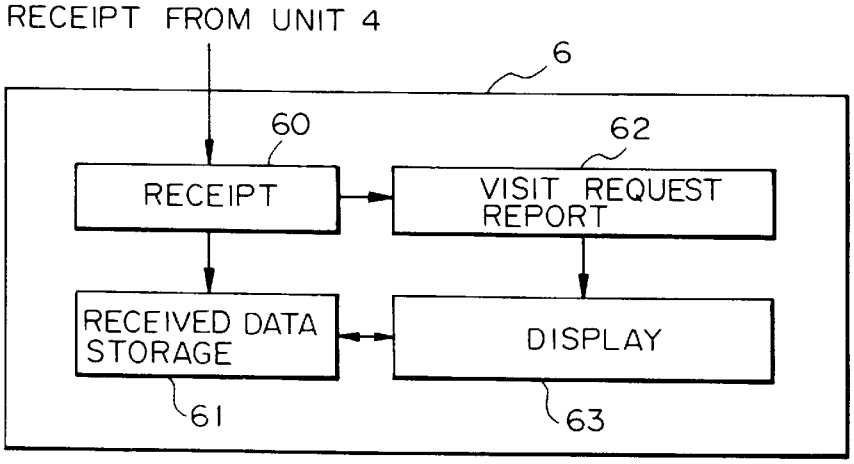

FIG. 7 shows the construction of one of the terminal units 6. As shown, the terminal unit 6 has a receipt 60, a received data storage 61, a visit request report 62, and a display 63. The receipt 60 receives the serviceman's visit request data and other data from the manager 4. The received data storage 61 stores the received data. The visit request report 62 reports the visit request received by the receipt 60. The display 63 displays the received data or jam alarm data.

Figure 8A:
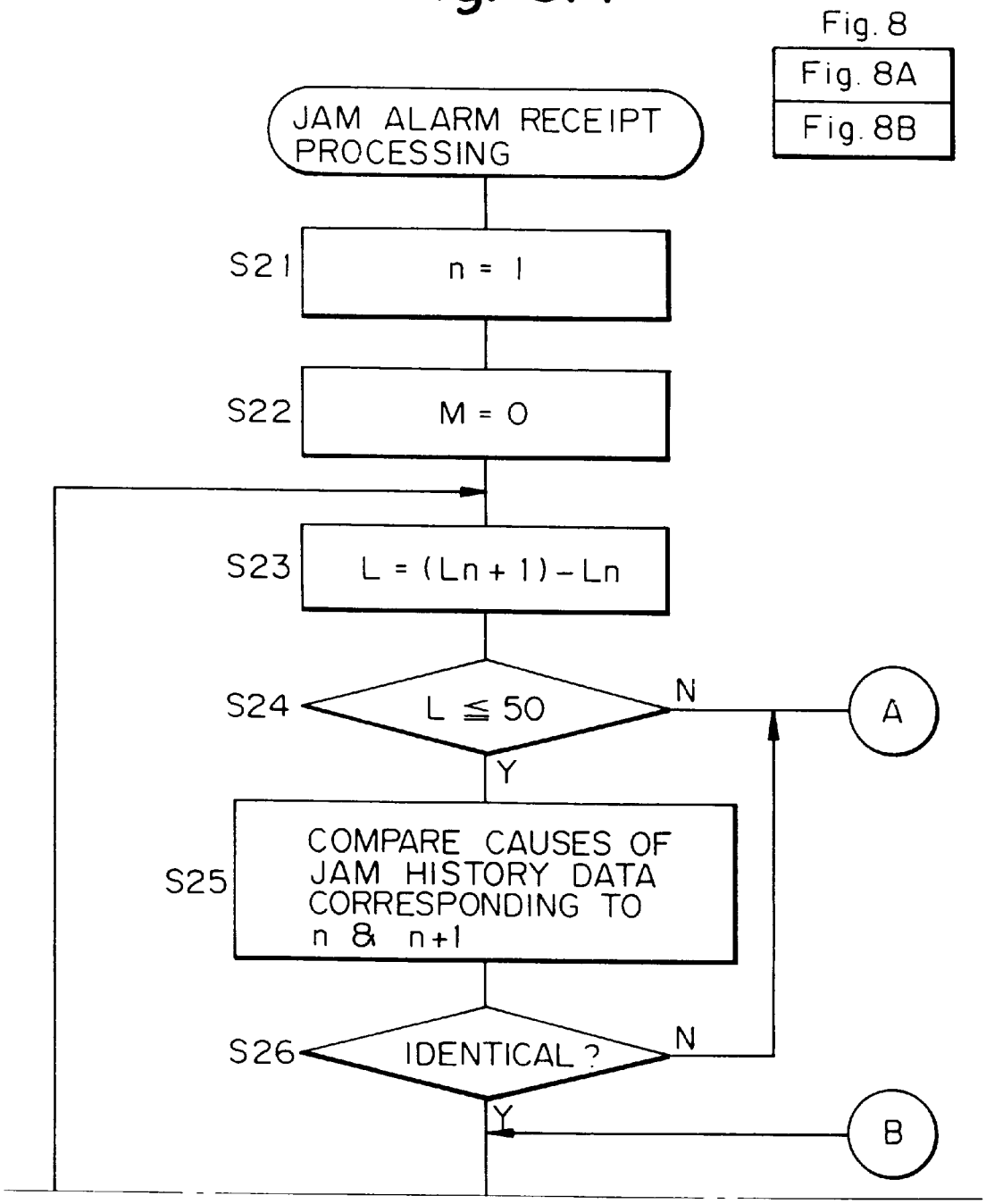
FIG. 8 is a flowchart showing a specific jam alarm receipt routine to be executed by the managing unit shown in FIG. 6.
Figure 8B:
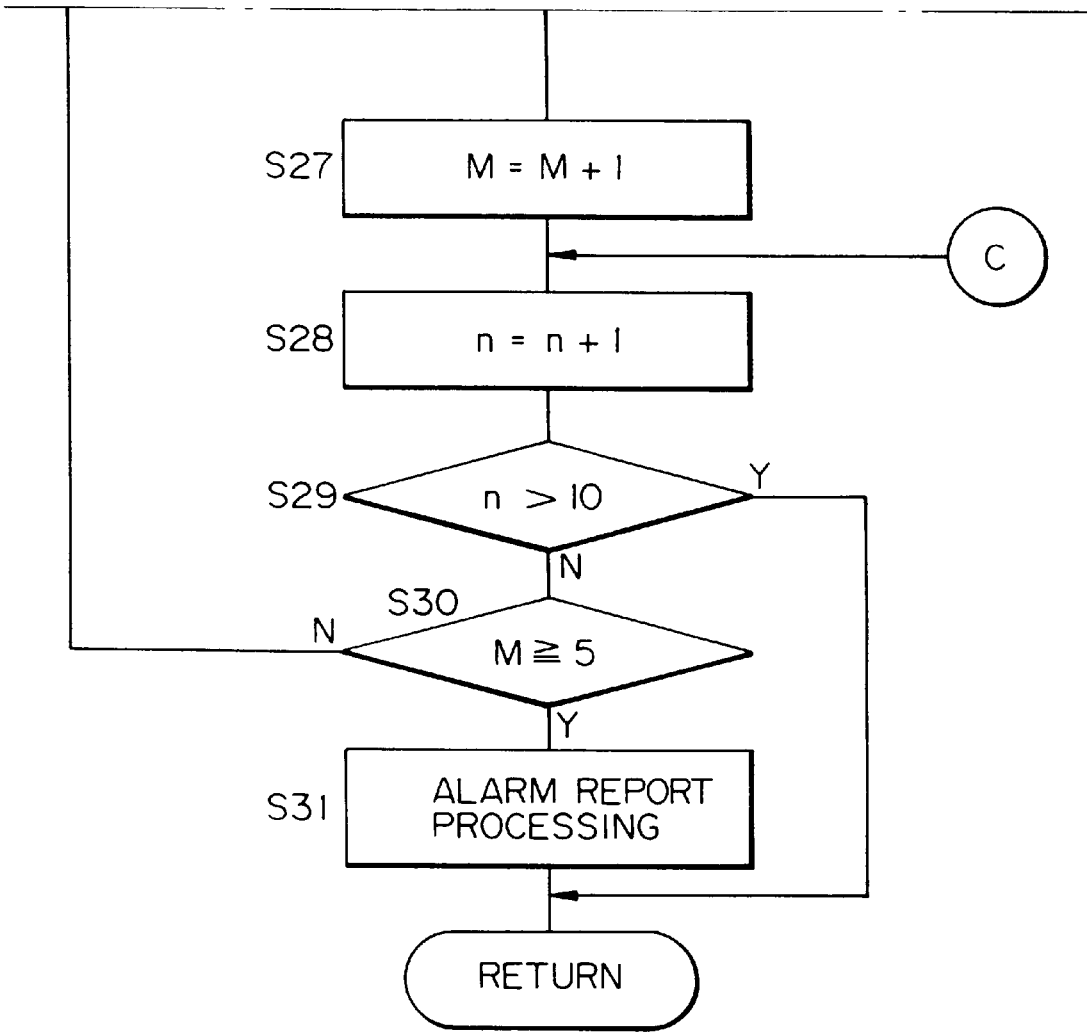
Figure 9:
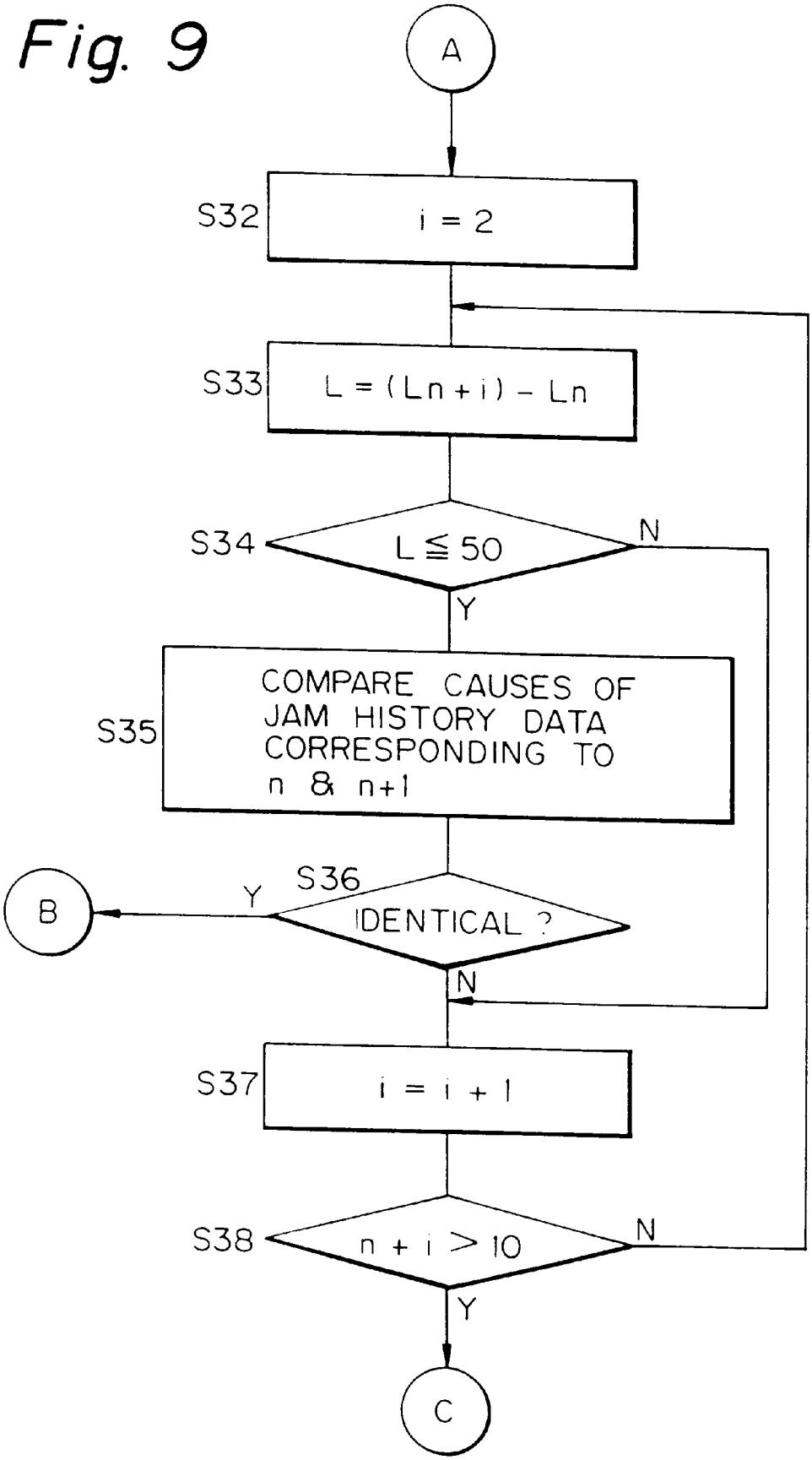
FIG. 9 is a flowchart showing a sequence of steps associated with the routine of FIG. 8.

Reference will be made to FIGS. 8 and 9 for describing a jam alarm receipt routine to be executed by the manager or host computer 4. This routine starts when the manager 4 receives the jam alarm data, state data (including the history of the latest ten times of jam) and copier ID from any one of the copiers 1, and writes such data in the storage 41. As shown in FIG. 8, "1" is set in a jam history data designate counter, not shown, as a count n (step S21). Then, "0" is set in an alarm report counter, not shown, as a count M (step S22). In this condition, the TC value Ln of, among the jam history data representative of the latest ten times of jam, the data corresponding to the count n is subtracted from the TC value Ln+1 of the data corresponding to a count n+1 (step S23). As a result, a difference L representative of the number of copies produced during the interval between the jams is determined. Subsequently, whether or not the number of copies L is smaller than or equal to "50" which is the reference number of copies or images formed (step S24). If the answer of step S24 is Y, the cause of the jam included in the data corresponding to the count n and the cause of the jam included in the data corresponding to the count n+1 are compared (step S25). Whether or not the two causes of the jams are identical is determined (step S26). If the answer of step S26 is Y, the count M of the alarm report counter is incremented (+1) (step S27).

Whether or not the count n of the history data designate counter has exceeded "10", i.e., whether or not the processing has been completed with all of the ten consecutive jam history data is determined (step S29). If the answer of step S29 is Y, it is determined that the received jam alarm data is invalid, i.e., that the probability of a trouble is low. As a result, a serviceman's visit is determined to be needless, and the program returns. If the answer of step S29 is N, whether or not the count M of the alarm report counter has reached "5" which is a preselected reference number (step S30) is determined. If the answer of step S30 is N, the program returns to step S23 in order to repeat the above processing. If the answer of step S30 is Y, the received jam alarm data is determined to be valid, and a serviceman's visit is determined to be necessary. Then, alarm report processing (step S31) is executed for sending serviceman's visit request data and data necessary for a service to the terminal unit 6 of the service station covering the copier 1 to be dealt with.

If the answer of step S24 is N or if the answer of step S26 is N, step S32 shown in FIG. 9 is executed. In step S32, "2" is set in an auxiliary counter, not shown, as a count i. Then, the TC value Ln of, among the data representative of the history of the latest ten times of jam, the data corresponding to the count n of the jam history designate counter from the TC value Nn+i (i being the count of the auxiliary counter). As a result, a difference L representative of the number of copies produced during the interval between the jams is produced (step S33). Subsequently, whether or not the number of copies L is smaller than or equal to "50" is determined (step S34). If the answer of step S34 is N, step S37 is executed. If the answer of step S34 is Y, the cause of the jam included in the jam history data corresponding to the count n and the cause of the jam included in the jam history data corresponding to the value n+i are compared (step S35). Whether or not the two causes of the jams are identical is determined (step S36).

If the answer of step S36 is Y, the program returns to step S27, FIG. 8, for repeating the same procedure. If the answer of step S36 is N, the count i of the auxiliary counter is incremented (+1) (step S37). Then, whether or not the resulting value n+i has exceeded "10" is determined (step S38). If the answer of step S38 is N, the operation returns to step S33. If the answer of step S38 is Y, the operation returns to step S28, FIG. 8.

As stated above, the manager 4 receives the jam alarm data and various status data (including the history data of the latest ten times of jam) from the individual copier 1, FIG. 1, and writes them in the storage 41. Then, the manager 4 analyzes the contents of the data written to the storage 41.

Assume that five (reference number) or more of the latest ten jam history data (state data) are derived from the same cause (or the same location) and occurred at intervals shorter than or equal to one corresponding to fifty copies (reference number). Then, the manager 4 determines that the jam alarm data is valid, and that a serviceman's visit is necessary. As a result, the manager 4 sends the serviceman's visit request data and data necessary for a service to the adequate terminal unit 6. If the result of the above decision on the latest ten jam history data is negative, the manager 4 determines that the jam alarm data is invalid, and that a serviceman's visit is needless. In this case, the manager 4 does not send any data to the terminal unit 6.

Therefore, on receiving the various kinds of data (jam alarm data, state data, etc.) from any one of the copiers 1 at a time, the manager 4 can readily see the location (cause) of the copier 1 where the jam is apt to occur frequently in the near future. In addition, the manager 4 can predict a trouble to occur in the copier 1. It follows that even when the copier 1 belongs to the low CV layer, a serviceman's visit is requested before a critical trouble occurs in the copier 1, urging a serviceman to take an adequate measure rapidly and efficiently. Moreover, the adequate prediction of a trouble in the copier 1 saves the data to be sent from the manager 4 to the terminal units 6, and thereby reduces the communication cost to a noticeable degree.

In the illustrative embodiment, the reference number of copies and the reference number are selected to be "50" and "5", respectively. Alternatively, such reference numbers may be varied on the panel 20 in matching relation to the user characteristic, recent operating condition, etc. Further, the reference numbers may be different from one copier to another.

The manager 4 writes the jam alarm data and various state data received from any one of the copiers 1 in the storage 41, and then analyzes the data, as stated earlier. After the analysis, the manager 4 may execute the following alternative procedure (1) and (2) or the procedure (3) and (4).

(1) Assume that more than the reference number of the latest ten jam history data are derived from papers of the same size and occurred at intervals shorter than a interval corresponding to the reference number of copies. Then, the manager 4 determines that the jam alarm data is valid, and that a serviceman's visit is necessary. As a result, the manager 4 sends the serviceman's visit request data and data necessary for a service to the adequate terminal unit 6.

(2) If the result of the above decision on the latest ten jam history data is negative, the manager 4 determines that the jam alarm data is invalid, and that a serviceman's visit is needless. In this case, the manager 4 does not send any data to the terminal unit 6.

(3) Assume that more than the reference number of the latest ten jam history data are derived from the same cause (or the same location) and papers of the same size and occurred at intervals shorter than a interval corresponding to the reference number of copies. Then, the manager 4 determines that the jam alarm data is valid, and that a serviceman's visit is necessary. As a result, the manager 4 sends the serviceman's visit request data and data necessary for a service to the adequate terminal unit 6.

(4) If the result of the above decision on the latest ten jam history data is negative, the manager 4 determines that the jam alarm data is invalid, and that a serviceman's visit is needless. In this case, the manager 4 does not send any data to the terminal unit 6.

The service system shown and described is similarly practicable with various abnormal phenomena or pre-phenomena other than the jam, e.g., fixing temperature and charge voltage which are also apt to result in troubles. While the illustrative embodiment has concentrated on copiers, the present invention is, of course, applicable to any other image forming apparatuses including printers, facsimile apparatuses, and simple printers.

In summary, it will be seen that the present invention provides an image forming apparatus service system including a shared managing unit capable of predicting whether or not a serviceman's visit is necessary on the basis of data received from each of image forming apparatuses, including low CV layer apparatuses, operated in a broad area including a number of service stations. The service system therefore allows a serviceman to take an adequate measure rapidly and efficiently before a critical trouble occurs in any one of the apparatuses.

Various modifications will become possible for those skilled in the art after receiving the teachings of the present disclosure without departing from the scope thereof.

What is claimed is:

1. An image forming apparatus service system comprising:

a plurality of image forming apparatuses;

a managing unit connected to said plurality of image forming apparatuses by a communication network for remote-managing said plurality of image forming apparatuses; and a plurality of terminal units connected to said managing unit by a communication network, and each being located at a particular service station;

said plurality of image forming apparatuses each sending, when an abnormal phenomenon or pre-phenomenon occurs during operation, alarm data indicative of said phenomenon or pre-phenomenon to said managing unit, said plurality of image forming apparatuses each including alarm data invalidating means for invalidating said alarm data based on whether a number of copies counted is less than a standard value when the abnormal phenomenon or pre-phenomenon occur, said managing unit analyzing said alarm data to thereby selectively send data relating to maintenance or repair to said plurality of terminal units;

said managing unit comprising:

received data storing means for storing data received from any one of said plurality of image forming apparatuses;

analyzing means for analyzing said data stored in said received data storing means;

predicting means for predicting, based on a result of analysis output from said analyzing means, whether or not a serviceman's visit is necessary; and transmitting means for transmitting a result of prediction output from said predicting means to one of said plurality of terminal units located at the service station covering the image forming apparatus needing a serviceman's visit.

2. An image forming apparatus service system comprising:

a plurality of image forming apparatuses;

a managing unit connected to said plurality of image forming apparatuses by a communication network for remote-managing said plurality of image forming apparatuses; and a plurality of terminal units connected to said managing unit by a communication network, and each being located at a particular service station;

said plurality of image forming apparatuses each sending, when an abnormal phenomenon or pre-phenomenon occurs during operation, alarm data indicative of said phenomenon or pre-phenomenon to said managing unity, said managing unit analyzing said alarm data to thereby selectively send data relating to maintenance or repair to said plurality of terminal units;

said managing unit comprising:

received data storing means for storing data received from any one of said plurality of image forming apparatuses;

analyzing means for analyzing said data stored in said received data storing means;

predicting means for predicting, based on a result of analysis output from said analyzing means, whether or not a serviceman's visit is necessary; and transmitting means for transmitting a result of prediction output from said predicting means to one of said plurality of terminal units located at the service station covering the image forming apparatus needing a serviceman's visit;

wherein said plurality of image forming apparatuses each comprises adding means for adding to said alarm data, state data including integrated numbers of images formed and each corresponding to one of a preselected number of latest abnormal phenomena or pre-phenomena occurred.

3. A service system as claimed in claim 2, wherein said plurality of image forming apparatuses further comprises:

a plurality of paper sensors each being positioned at a particular location on a paper transport path;

jam detecting means for detecting a paper jam during operation location by location on the basis of outputs of said plurality of paper sensors;

standard value storing means for storing location-by-location standard paper jam values corresponding to numbers of images formed and used to determine whether or not jam data is valid;

image counting means for counting images continuously formed without any paper jam;

jam alarm counting means for counting, when said jam detecting means detects a paper jam at any one of the locations, jam occurrence data if a count output from said image counting means is not greater than said standard paper jam value; resetting a count of said jam occurrence data when the count of said image counting means reaches said standard paper jam value before said jam detecting means detects a paper jam at said one location later; and outputting, when the count of said jam occurrence data reaches a preselected reference value, jam alarm data showing that a probability of frequent jam is high; and jam alarm data transmitting means for transmitting to said managing unit the location-by-location jam alarm data output from said jam alarm counting means as said alarm data, while adding said state data to said location-by-location jam alarm data;

said predicting means of said managing unit determining, on determining that more than a preselected reference number of said data stored in said received data storing means together with said jam alarm data are representative of paper jams derived from a same location or a same cause and occurred at intervals shorter than an interval corresponding to a preselected reference number of images on the basis of a result of analysis output from said analyzing means, that said jam alarm data is valid data indicative of a high probability of a trouble, and predicting that a serviceman's visit is necessary.

4. A service system as claimed in claim 3, wherein said managing unit further comprises setting means for allowing a desired number of state data to be set.

5. A service system as claimed in claim 3, wherein said managing unit further comprises setting means for allowing a desired reference number of images to be set.

6. A service system as claimed in claim 3, wherein said predicting means of said managing unit determines, on determining that more than said preselected reference number of said data representative of the paper jams derived from the same location or the same cause and occurred at said intervals are not present, that said jam alarm data is invalid data indicative of a low probability of a trouble, and predicts that a serviceman's visit is not necessary.

7. A service system as claimed in claim 6, wherein said managing unit further comprises setting means for allowing a desired number of state data to be set.

8. A service system as claimed in claim 6, wherein said managing unit further comprises setting means for allowing a desired reference number of images to be set.

9. A service system as claimed in claim 8, wherein said managing unit further comprises setting means for allowing a desired number of state data to be set.

10. A service system as claimed in claim 2, wherein said plurality of image forming apparatuses each comprises:

a plurality of paper sensors each being positioned at a particular location on a paper transport path;

jam detecting means for detecting a paper jam during operation location by location on the basis of outputs of said plurality of paper sensors;

standard value storing means for storing location-by-location standard paper jam values corresponding to numbers of images formed and used to determine whether or not jam data is valid;

image counting means for counting images continuously formed without any paper jam;

jam alarm counting means for counting, when said jam detecting means detects a paper jam at any one of the locations, jam occurrence data if a count output from said image counting means is not greater than said standard paper jam value; resetting a count of said jam occurrence data when the count of said image counting means reaches said standard paper jam value before said jam detecting means detects a paper jam at said one location later; and outputting, when the count of said jam occurrence data reaches a preselected reference value, jam alarm data showing that a probability of frequent jam is high; and jam alarm data transmitting means for transmitting to said managing unit the location-by-location jam alarm data output from said jam alarm counting means as said alarm data, while adding said state data to said location-by-location jam alarm data;

said predicting means of said managing unit determining, on determining that more than a preselected reference number of said data stored in said received data storing means together with said jam alarm data are representative of paper jams derived from a same paper size and occurred at intervals shorter than an interval corresponding to a preselected reference number of images on the basis of a result of analysis output from said analyzing means, that said jam alarm data is valid data indicative of a high probability of a trouble, and predicting that a serviceman's visit is necessary.

11. A service system as claimed in claim 10, wherein said managing unit further comprises setting means for allowing a desired number of state data to be set.

12. A service system as claimed in claim 10, wherein said managing unit further comprises setting means for allowing a desired reference number of images to be set.

13. A service system as claimed in claim 12, wherein said managing unit further comprises setting means for allowing a desired number of state data to be set.

14. A service system as claimed in claim 10, wherein said predicting means of said managing unit determines, on determining that more than said preselected reference number of said data representative of the paper jams derived from the same paper size and occurred at said intervals are not present, that said jam alarm data is invalid data indicative of a low probability of a trouble, and predicts that a serviceman's visit is not necessary.

15. A service system as claimed in claim 14, wherein said managing unit further comprises setting means for allowing a desired number of state data to be set.

16. A service system as claimed in claim 14, wherein said managing unit further comprises setting means for allowing a desired reference number of images to be set.

17. A service system as claimed in claim 16, wherein said managing unit further comprises setting means for allowing a desired number of state data to be set.

* * * * *